US006722378B2

(12) United States Patent
Heiberg et al.

(10) Patent No.: US 6,722,378 B2
(45) **Date of Patent: *Apr. 20, 2004**

(54) GUN RACK FOR ULTRASONIC CLEANING

(75) Inventors: Eric Heiberg, Morristown, NJ (US); Jerry Sullivan, Ridgewood, NJ (US)

(73) Assignee: Coltene/Whaledent, Inc., Mahwah, NJ (US)

( * ) Notice: Subject to any disclaimer, the term of this patent is extended or adjusted under 35 U.S.C. 154(b) by 8 days.

This patent is subject to a terminal disclaimer.

(21) Appl. No.: 10/215,412

(22) Filed: Aug. 8, 2002

(65) Prior Publication Data

US 2002/0189653 A1 Dec. 19, 2002

Related U.S. Application Data

(63) Continuation of application No. 09/800,303, filed on Mar. 2, 2001, now Pat. No. 6,463,944.

(51) Int. Cl.[7] ..... B08B 3/10

(52) U.S. Cl. ..... 134/166 R; 134/170; 134/184; 134/201; 42/95

(58) Field of Search ..... 134/166 R, 135, 134/169 R, 170, 184, 201

(56) References Cited

U.S. PATENT DOCUMENTS

| | | | | |
|---|---|---|---|---|
| 1,653,577 | A | * | 12/1927 | Krafft |
| 1,939,504 | A | | 3/1933 | Lee |
| 1,946,181 | A | * | 2/1934 | Stoddard |
| 2,403,526 | A | * | 7/1946 | Harris |
| 2,758,330 | A | * | 8/1956 | Sloan |
| 2,793,761 | A | | 5/1957 | Geralds |
| 2,854,012 | A | * | 9/1958 | Murdoch, Jr. |
| 2,882,708 | A | * | 4/1959 | Hancock et al. |
| 2,945,760 | A | | 7/1960 | Ostergaard, Jr. |
| 2,994,332 | A | | 8/1961 | Leonhardt |
| 3,050,073 | A | * | 8/1962 | McMillan |
| 3,348,556 | A | | 10/1967 | Layton |
| 3,487,951 | A | | 1/1970 | Beltzung |
| 3,709,732 | A | | 1/1973 | Thomen |
| 3,858,835 | A | | 1/1975 | Baren |
| 3,900,109 | A | * | 8/1975 | Peterson |
| 3,961,984 | A | * | 6/1976 | Torressen |
| 4,045,900 | A | | 9/1977 | Byer |
| 4,432,380 | A | | 2/1984 | Ruf et al. |
| 4,442,852 | A | | 4/1984 | Lord |
| 4,528,997 | A | | 7/1985 | Hoppestad et al. |
| 4,649,946 | A | | 3/1987 | Yano |
| 5,159,945 | A | | 11/1992 | Bannon |
| 5,202,523 | A | | 4/1993 | Grossman et al. |
| 5,649,630 | A | | 7/1997 | Remmler |
| 5,871,115 | A | | 2/1999 | Kohn |
| 5,927,304 | A | | 7/1999 | Wen |
| 5,937,875 | A | * | 8/1999 | Nygren |

FOREIGN PATENT DOCUMENTS

| | | | |
|---|---|---|---|
| DE | 3107650 | * | 9/1982 |
| DE | 100 01 071 | * | 10/1999 |
| JP | 59-104132 | * | 6/1984 |
| JP | 64-34647 | * | 2/1989 |
| JP | 1-126940 | | 5/1989 |
| JP | 3-143581 | | 6/1991 |
| JP | 5-211974 | * | 8/1993 |
| JP | 9-164533 | | 6/1997 |
| JP | 11-197612 | * | 7/1999 |
| JP | 2000-1799 | * | 1/2000 |
| JP | 2000-001799 | | 1/2000 |

* cited by examiner

*Primary Examiner*—Frankie L. Stinson
(74) *Attorney, Agent, or Firm*—Katten Muchin Zavis Rosenman

(57) ABSTRACT

A retainer for supporting gun parts in an ultrasonic bath is provided with a plurality of supports that retain such gun parts in positions whereby cleaning of such parts by ultrasonic means is optimized. The retainer supports are specifically configured to maximize the removal of dirt and debris from gun parts, and certain supports are adjustable to accommodate a variety of gun makes and models. The retainer is also constructed to prevent direct contact between gun parts, which might otherwise result in unnecessary wearing at such contact locations.

29 Claims, 14 Drawing Sheets

GUN RACK FOR ULTRASONIC CLEANING

CROSS-REFERENCE TO RELATED APPLICATIONS

This is a continuation of U.S. application Ser. No. 09/800,303, filed Mar. 2, 2001, now U.S. Pat. No. 6,463,944.

FIELD OF THE INVENTION

This invention relates to ultrasonic cleaning racks in general, and more specifically, to a rack specifically adapted to support gun parts immersed in an ultrasonic cleaning bath.

BACKGROUND OF THE INVENTION

Most firearms malfunction or misfire as a result of jammed parts that are dirty or otherwise imbedded with debris. A malfunctioning handgun can be life-threatening to a member of law enforcement, for example, if an officer must take down a criminal a split-second before being taken down himself or herself. To avoid such life-threatening mishaps, a firearm must be cleaned constantly and thoroughly so that it can be relied upon in emergency situations.

It is known to clean handguns using ultrasonic cleaning methods. Ultrasonic cleaning relies on rapid vibrations or waves transmitted through a solution that dislodge debris and dirt particles stuck to a gun surface. To have the greatest cleaning effectiveness, such waves should directly impinge upon the surface to be cleaned. Any barrier between the radiating or vibrating waves and the item to be cleaned will impede and diminish cleaning effectiveness.

In traditional ultrasonic cleaning baths, gun parts are thrown into a basket in which the gun parts contact both each other and the floor of the basket. Such contact is undesirable because ultrasonic cleaning involves very rapid vibrations, these vibrations in turn make both the objects to be cleaned and the basket vibrate, and any direct contact between vibrating bodies, such as a cleaning basket and the object to be cleaned causes unnecessary wear at the contact points. Also, anything between the radiating floor of the ultrasonic cleaning bath and the object to be cleaned acts as a barrier and reduces cleaning effectiveness. When ultrasonic waves impinge upon a barrier typically three things happen. Some of the energy they carry is absorbed by the material of that barrier, some of the energy is reflected from the barrier back towards the floor of the ultrasonic cleaner in the form of ultrasonic waves and some of the energy is transmitted through the barrier in the form of ultrasonic waves. In any case, a barrier does not allow the full amount of energy radiant from the floor of the ultrasonic cleaner to reach the object to be cleaned.

Additionally it is important that any dirt or debris that is dislodged from the object being cleaned fall away from the object so that it does not redeposit onto the object.

When the object to be cleaned is a firearm it is important that all the parts from one firearm are kept in an organized fashion before during and after the cleaning such that they are not mixed up with parts from any other firearms being cleaned at the same time. This is important since parts from different firearms may not fit well together and may cause the firearm to malfunction.

When cleaning firearms, it is critical, as noted above, that all parts are cleaned thoroughly and effectively. It is also critical, particularly with ultrasonic cleaning methods, that there are no unnecessary wear points created as a result of the contact between gun parts and a vibrating retaining surface. Thus, there is a need for a support structure for retaining gun parts in an ultrasonic cleaning apparatus that does not impede the cleaning effectiveness of the ultrasonic vibrations and that does not cause excessive wear between gun parts that contact each other. Such need is met by the gun rack of the present invention.

The gun rack of the present invention is specifically adapted for retaining gun parts in a manner that maximizes cleaning of such parts in an ultrasonic bath. When the gun rack of the invention is placed in an ultrasonic bath, unimpeded ultrasonic vibrations cause debris to separate from the gun parts and fall away from the gun to the bottom of the bath. Gun parts are placed on the rack of the invention in order to maximize their exposure to ultrasonic vibrations and to minimize their contact with other parts. The rack of the invention is also preferably coated in a material softer than the gun (i.e. plastic) such that the softer material will wear instead of the gun.

OBJECTS OF THE INVENTION

It is an object of the present invention, therefore, to provide a rack for supporting gun parts in an ultrasonic cleaning bath.

It is a further object of the present invention to provide a rack for maximizing the removal of dirt and debris from gun parts in an ultrasonic cleaning bath. It is a further object of the present invention to provide a rack which will prevent or minimize the re-deposition of dirt and debris onto the gun.

It is a further object of the present invention to provide a rack that prevents unnecessary wear between gun parts supported on such rack.

It is a further object of the present invention to provide a rack for supporting gun parts wherein at least some of said gun parts are adjustably supported on said rack.

It is a further object of the present invention to provide a gun rack for ultrasonic cleaning that is easy to use, compact in design and results in the efficient positioning of gun parts that are cleaned in a relatively confined environment.

It is a further object of the present invention to provide a gun rack for ultrasonic cleaning that organizes the parts from a single gun onto that that rack so as to minimize the possibility of mixing the parts from more than one gun together.

Still other objects and advantages of the invention will become clear upon review of the following detailed description in conjunction with the appended drawings.

SUMMARY OF THE INVENTION

A rack for supporting gun parts in an ultrasonic cleaning environment comprises a plurality of supports that are specially configured and adapted to retain gun parts in positions that maximize the cleaning of such parts in a compact, ultrasonic cleaning environment. The rack supports are specifically adapted to maximize the removal of debris from gun parts, wherein certain supports are adjustable to accommodate a variety of gun makes and models. The rack is also constructed to prevent direct contact between gun parts, which might otherwise result in unnecessary wearing at such contact locations. To prevent the dampening of ultrasonic waves and a reduction in cleaning effectiveness, the rack is specifically adapted to be suspended off the radiating surface in an ultrasonic cleaning bath, and the gun parts are separately supported at various locations along the rack to receive the maximum cleaning impact from the ultrasonic cleaning waves.

DETAILED DESCRIPTION OF THE PREFERRED EMBODIMENTS

Figure 1:
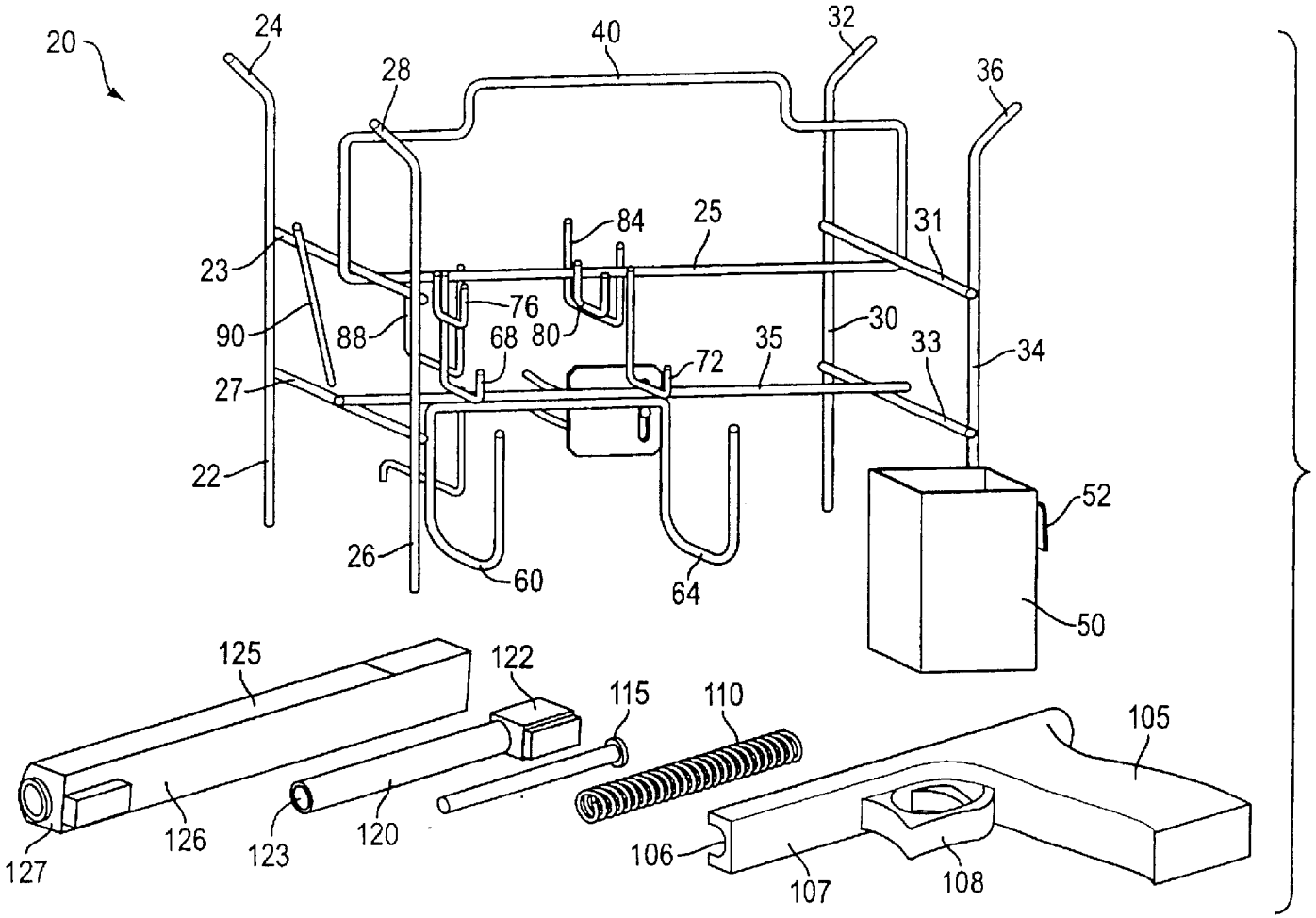
FIG. 1 is a three-dimensional view of the gun rack of the present invention with a display of gun parts to be held by said rack.

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention. In the various views of the drawings, like reference characters designate like or similar parts.

FIG. 1 illustrates the gun rack 20 of the present invention shown with a gun lower receiver 105, gun recoil spring 110, recoil spring guide 115, gun barrel 120 and gun slide 125, collectively designated as gun parts 100, to be supported thereon as will be described below. The gun rack 20 is particularly shown in FIGS. 2–5 and comprises a plurality of legs 22, 26, 30 and 34 having angled upper ends 24, 28, 32 and 36. Each pair of legs 22,26 and 30,34 is connected by a plurality of horizontal members 23,27 and 31,33, and each pair of horizontal members 23,27 and 31,33 is further connected by extension members 25,35 respectively spanning across the rack 20. A handle 40 for carrying the rack 20 is formed from extension member 25, and a small parts basket 50 is attachable to the gun rack 20 by an attaching means 52 as will be described below.

Figure 2:
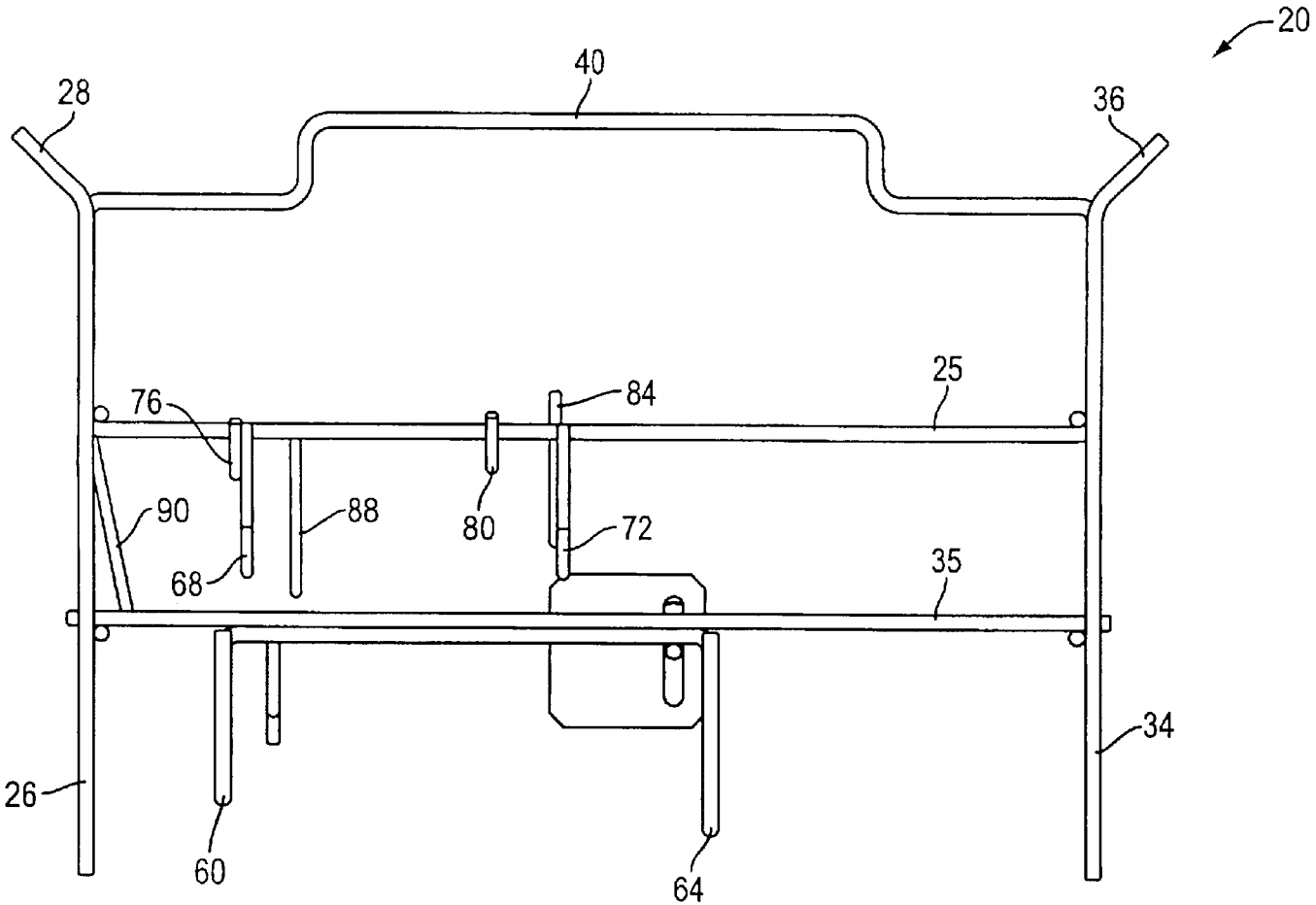
FIG. 2 is a front view of the gun rack of FIG. 1.
Figure 6:
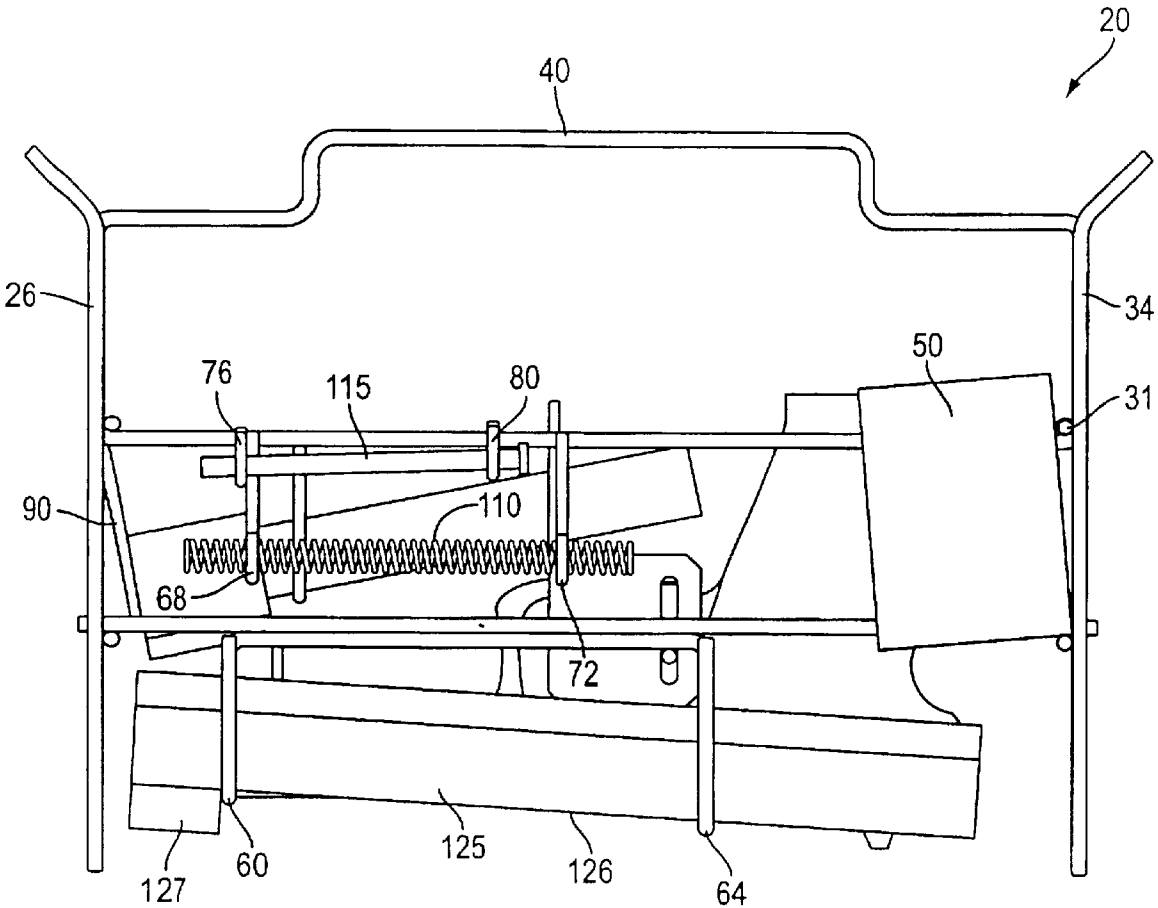
FIG. 6 is a front view of the gun rack of the present invention with gun parts supported on said rack.
Figure 9B:
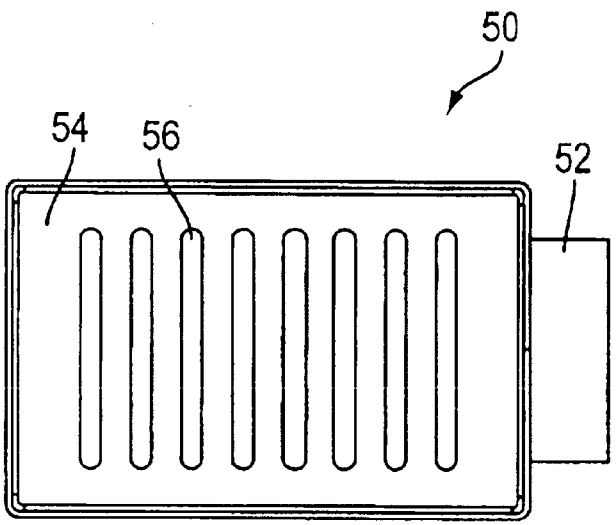
FIG. 9B is a top view of the parts basket adapted for placement on the gun rack of the present invention.
Figure 9A:
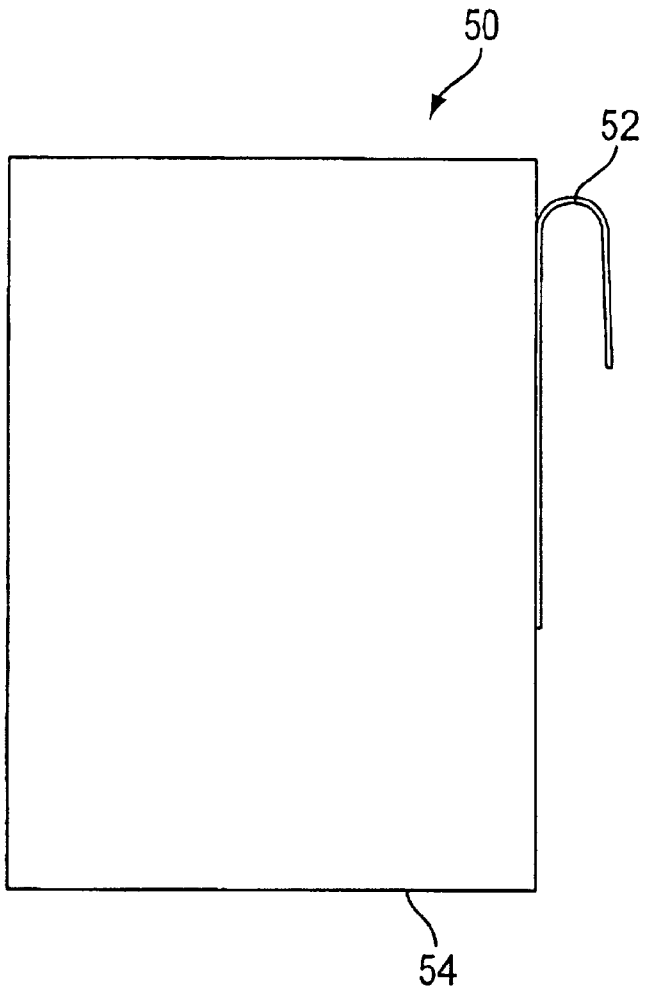
FIG. 9A is a side view of a parts basket adapted for placement on the gun rack of the present invention.
Figure 10:
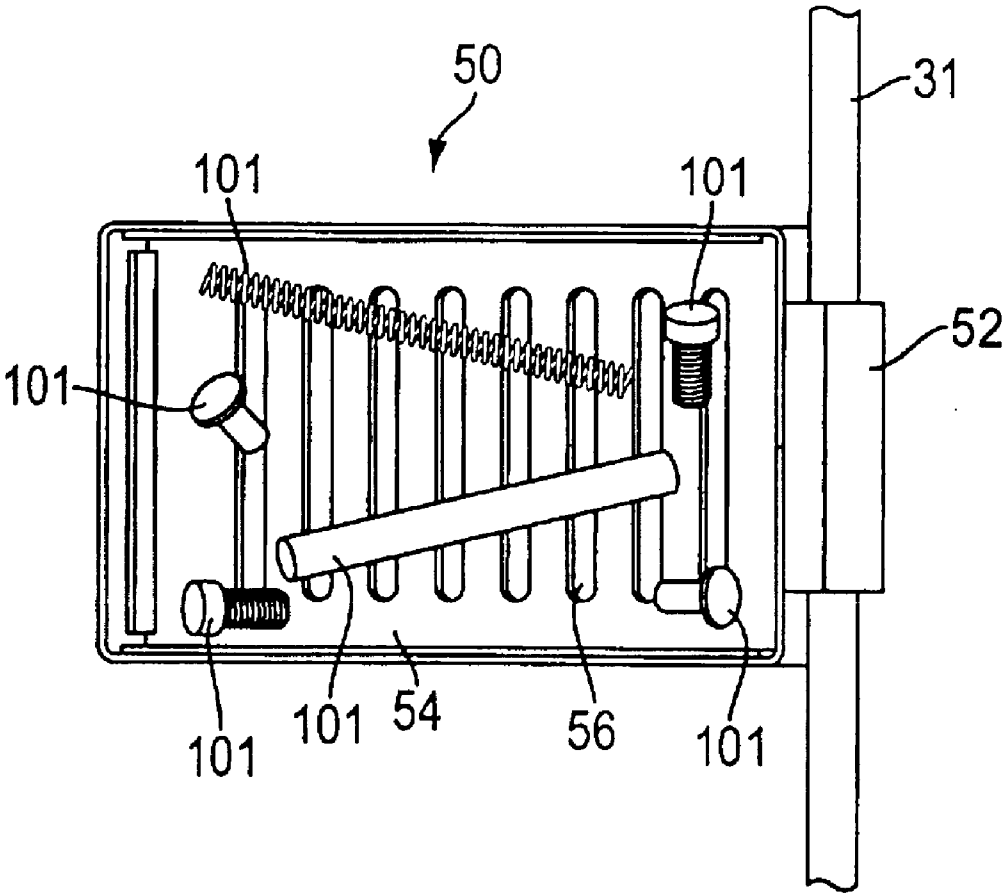
FIG. 10 is a top view of the parts basket of FIGS. 9A and 9B holding gun parts and attached to the gun rack of the present invention.

With particular reference to FIGS. 2 and 6, the front of the gun rack 20 is further provided with supports 60,64 adapted to support the gun slide 125 in a horizontal or angled orientation, supports 68,72 adapted to support recoil spring 110 and supports 76,80 adapted to support recoil spring guide 115 in a horizontal or angled orientation. The recoil spring supports 68,72 and recoil spring guide supports 76,80 merely hold such respective parts 110 and 115 in the horizontal orientation, and such parts 110, 115 may be interchangeably supported on supports 68,72 and 76,80 as desired. The small parts basket 50 may be placed anywhere on the rack 20, although in FIG. 6 it is shown on the front side of the rack 20 attached to horizontal member 31. Basket 50, which is particularly shown in FIGS. 9A, 9B and 10 and attached to the rack 20 via attachment means 52, further comprises a floor 54 having orifices 56 dimensioned to retain the smallest of the miscellaneous small parts 101 stripped from a gun. Small parts basket 50 is preferably used to retain small parts 101 produced when a firearm is "fully" or "detail" stripped, although such basket is not necessarily utilized when a firearm is "field" stripped, in which case only larger gun parts 100 (FIG. 1) would be disassembled and cleaned.

Supports 60,64 are preferably arranged in a sloping fashion, i.e. support 60 is higher than support 64, so as to orient support slide 125 with its "dirty side" 126 facing down toward the bottom of the rack 20. That is, the "dirty side" 126 is the side that contacts the barrel 120 and lower receiver 105 when the gun is assembled, which side 126 is the most contaminated with debris as a result of the firing of an assembled gun. The enlarged discharge end 127 is placed on the opposite side of support 60 from support 64 and prevents the slide 125 from sliding off the sloped supports 60,64.

Figure 3:
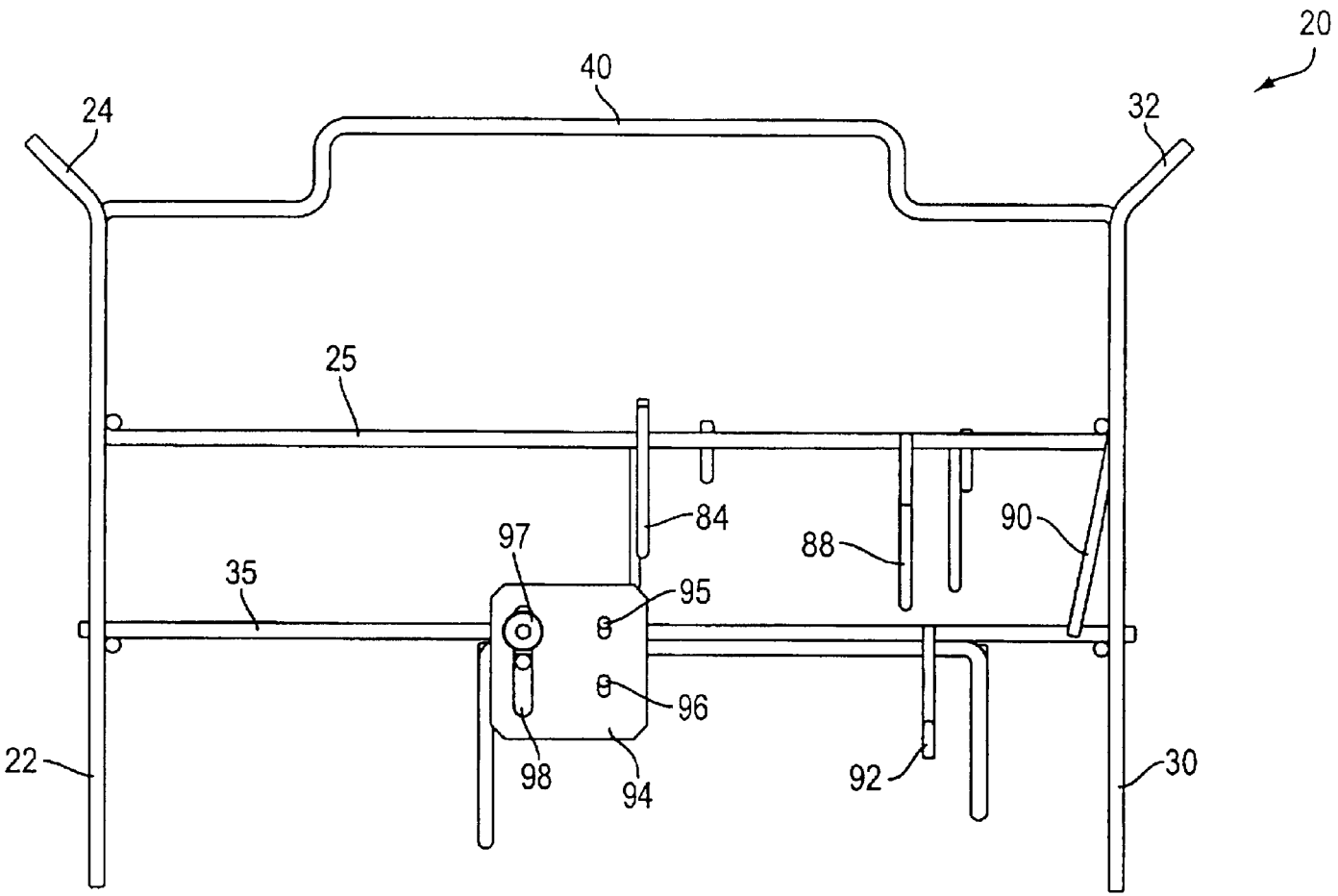
FIG. 3 is a rear view of the gun rack of FIG. 1.
Figure 5:
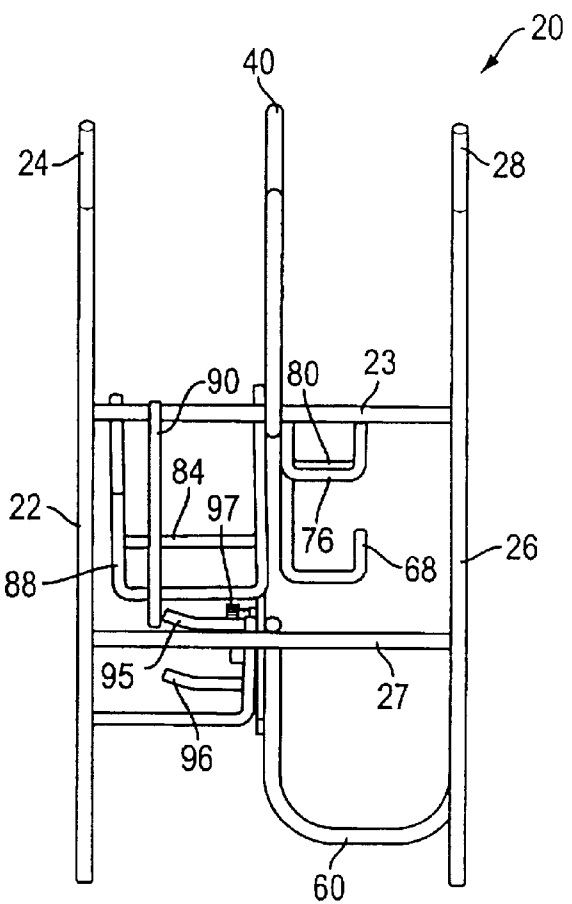
FIG. 5 is a left side view of the gun rack of FIG. 1.
Figure 4:
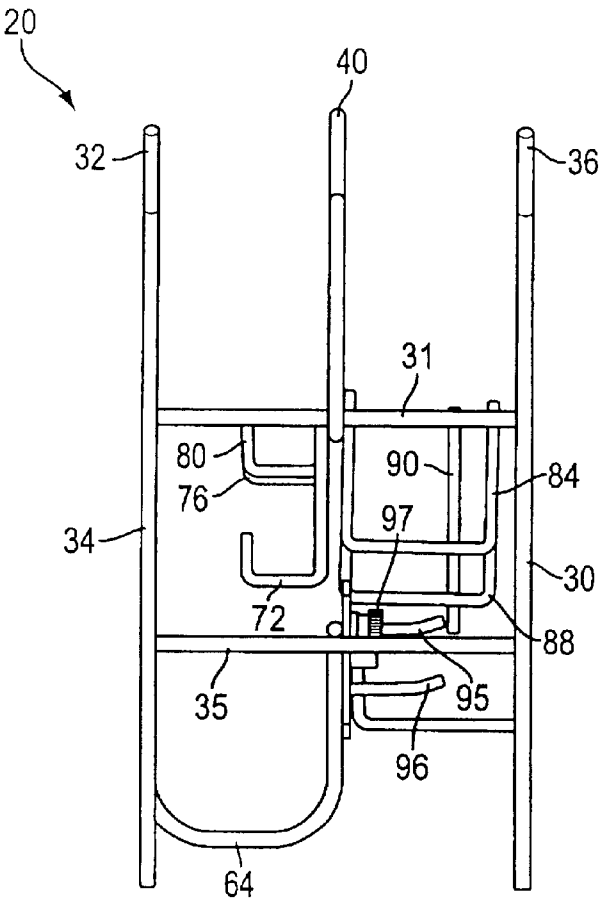
FIG. 4 is a right side view of the gun rack of FIG. 1.
Figure 7:
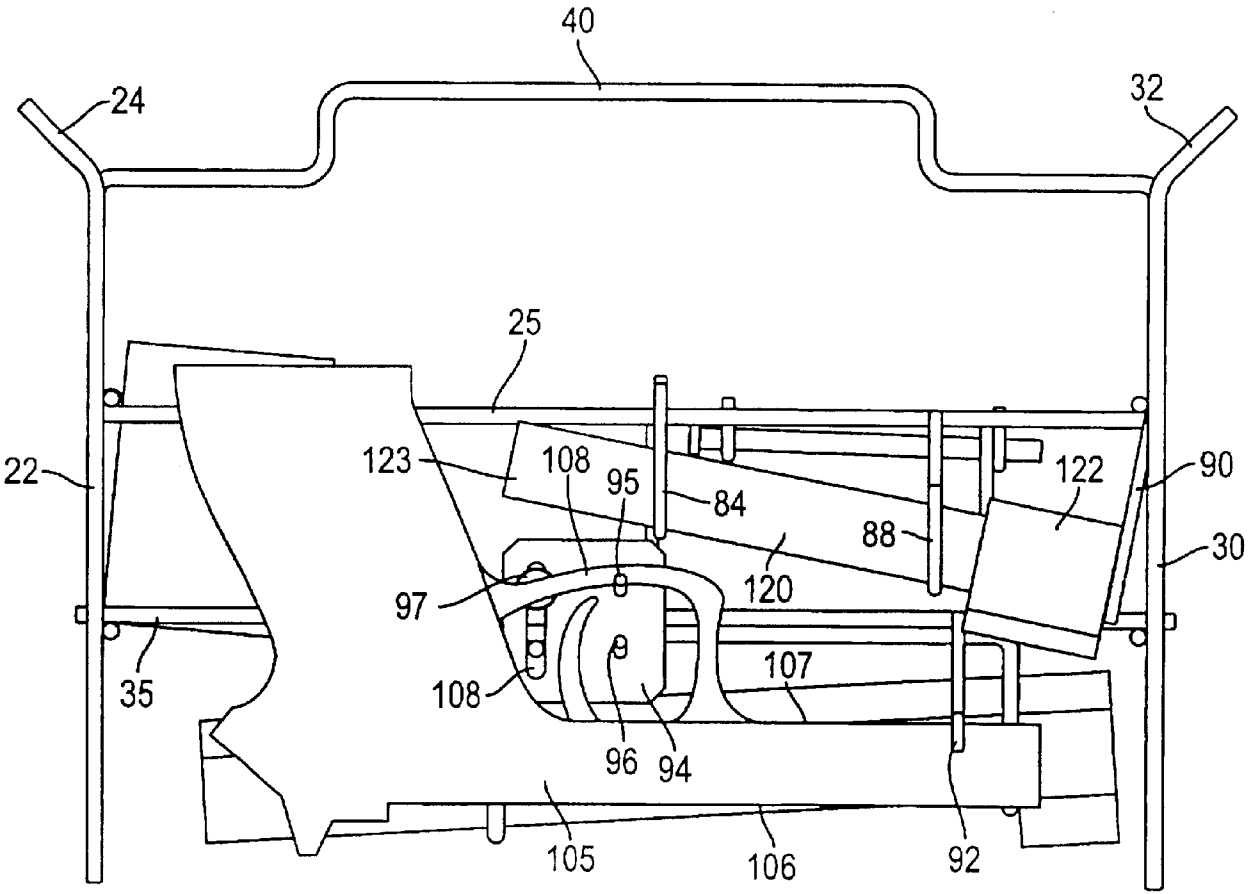
FIG. 7 is a rear view of the gun rack of the present invention with gun parts supported on said rack.

With particular reference to FIGS. 3 and 7, the back side of the gun rack 20 is further provided with supports 84,88,90 adapted to support the barrel 120, and supports 92,94 adapted to support the lower receiver 105. Supports 84,88 are preferably arranged in a sloping fashion, i.e. support 84 is preferably higher than support 88, so as to orient the larger part 122 of the barrel 120 downward toward the bottom of the rack 20. The larger part 122 initially receives and transmits a bullet upon firing (not shown), which part thus collects the most debris. There is usually less debris present at the other end 123 through which the bullet exits. Thus, the sloped supports 84,88 accommodate the gun barrel 120 "dirty end" down, or with the larger end 122 oriented downward, and such larger end 122 is prevented from sliding off the supports 84,88 by a stop member 90.

Figure 12:
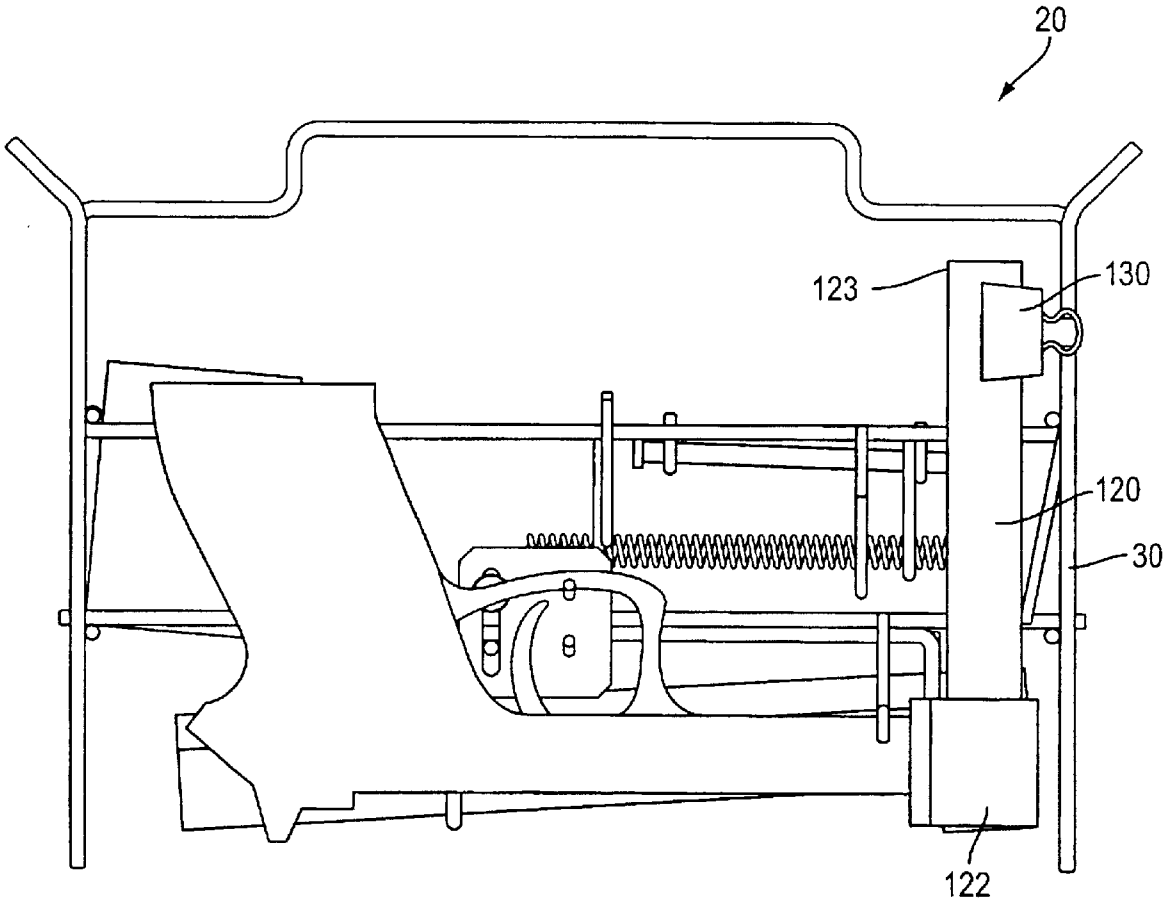
FIG. 12 is a front view of an alternative embodiment of the gun rack of present invention with a gun barrel supported in a vertical orientation on said rack.

FIG. 7 illustrates the positioning of the gun barrel 120 on the rack 20 in a downward sloping orientation. However, while such positioning is preferable, alternative methods of supporting the barrel 120 are possible. For example, as shown in FIG. 12, the gun barrel 120 may be vertically supported such that its larger end 122 is oriented below its exit end 123. In this case, the barrel 120 may be supported by a clip 130 or the like, which is fastened or otherwise connected to one of the legs 30.

Gun parts may be positioned in a variety of orientations on the gun rack 20 of the invention. However, it is most preferable if such parts are positioned to maximize the ultrasonic cleaning effectiveness. In most cases, this means that such parts 100 should be positioned with debris-laden surfaces or ends facing the bottom of the rack 20 and the bottom surface 210 (FIG. 11) of an ultrasonic cleaning bath 200 from where the ultrasonic waves typically emanate.

The lower receiver 105 is supported on the gun rack 20 of the invention (FIG. 7) upside down, or with its "dirty side" 106 down. That is, the "dirty side" 106 is the side with which the barrel 120 makes contact when the gun is assembled, which side 106 is the most contaminated with debris and sediment as a result of the firing of an assembled gun. Also, effective cleaning of the "dirty side" 106 of the lower receiver 105 is critical to the proper operation of the gun, for any debris that hinders the contact between the lower receiver 105 and barrel 120 or slide 125 can cause the gun to jam or otherwise become inoperative. Positioning the lower receiver 105 with the "dirty side" 106 down causes the dislodged debris and sediment to merely fall from the receiver 105 to the floor 210 (FIG. 11) of the ultrasonic cleaning bath 200 (FIG. 1I described below).

Figure 8B:
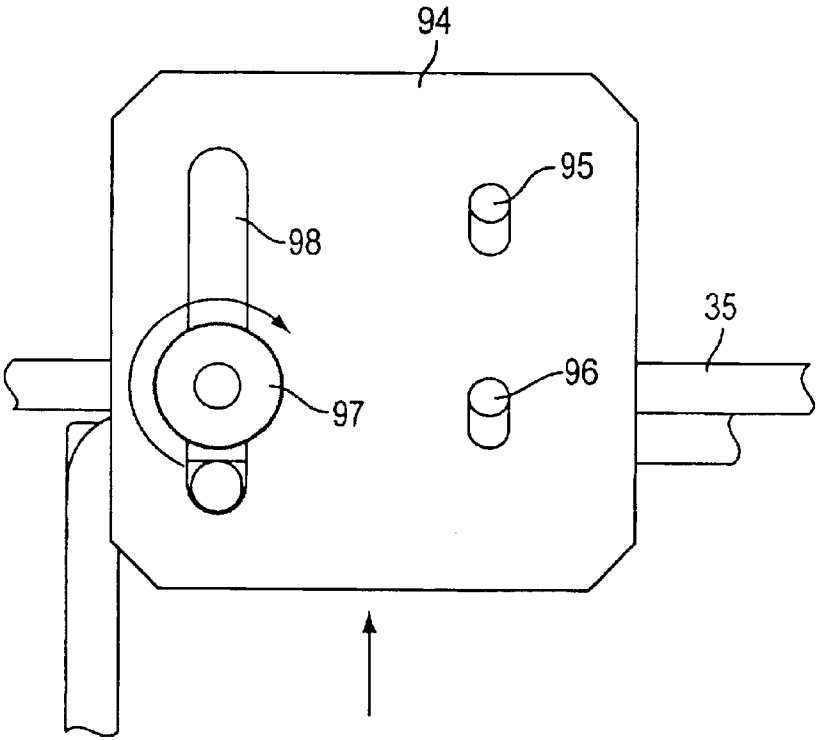
FIGS. 8A and 8B are close-up views of the adjustable receiver support of the present invention.
Figure 8A:
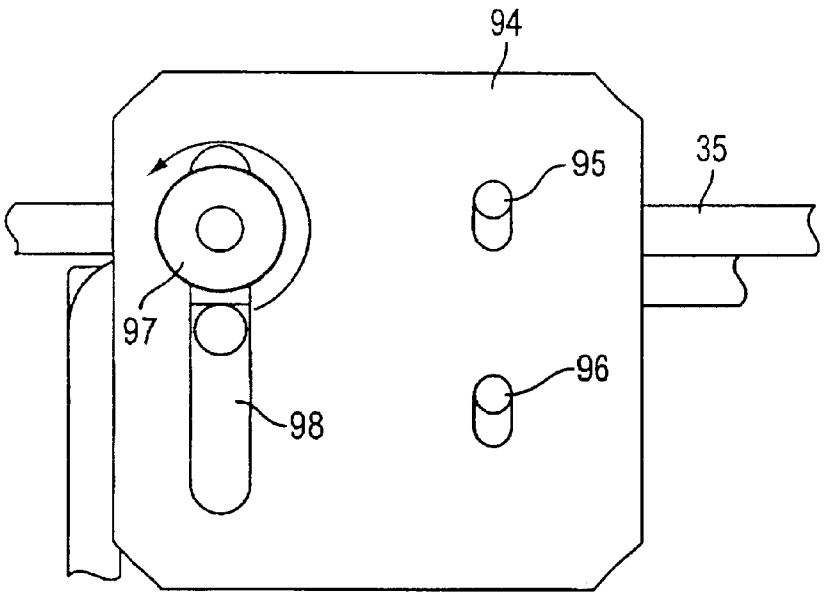
Figure 13:
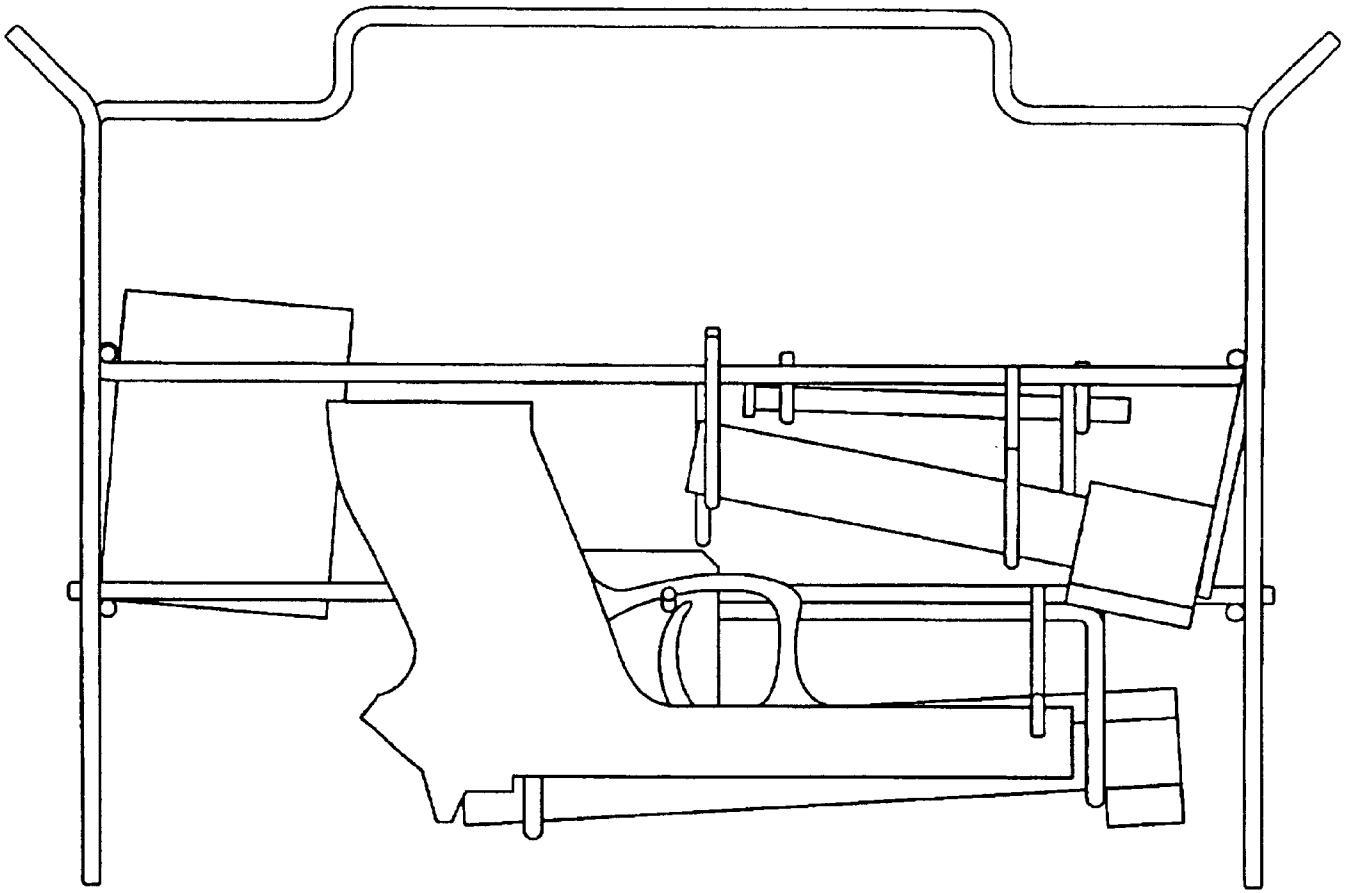
FIG. 13 is a front view of the gun rack of the present invention supporting a smaller gun.

Supports 92 and 94 maintain the lower receiver 105 in an upside down orientation. Support 92 contacts the underside 107 of the lower receiver while support 94 further comprises dual supports 95,96 for contacting the trigger section 108. Support 92 actually prevents the lower receiver 105 from rotating around support 94 and thus maintains lower receiver 105 in a substantially horizontal orientation. Support 94, shown in detail in FIGS. 8A and 8B, is preferably height-adjustable with respect to extension member 34 to which it is connected. A threaded rod onto which a thumb nut 97 is placed is slidable within a slot 98 present on the support 94. Support plate 94 may be raised from a position shown in FIG. 8A to a position shown in FIG. 8B by loosening (counterclockwise rotation) the thumb nut 97 (FIG. 8A), sliding the adjustable support 94 along slot 98 to a desired height with respect to the Support 92, and tightening the thumb nut 97 with a clockwise rotation (FIG. 8B). The adjustable support 94 is provided to accommodate most handgun sizes used by law enforcement, whether such handguns are on the longer side as shown in FIG. 7, or the shorter side as shown in FIG. 13.

Most of the supports, such as supports 60, 64, 68, 72, 84 and 88 for example, provided on the gun rack 20 preferably have a "U" shaped profile. Such profile prevents the gun parts 100, and in particular the lower receiver 105 and slide 125 from tilting on its side while being supported. With the slide 125, for example, it is important that the "dirty side" 126 is always facing downward, so that debris and sediment can fall from such side 126 in an unobstructed fashion. If the slide 125 were tilted on its side, it is possible that some debris and sediment would remain on the surface 126, thereby necessitating secondary wiping or cleaning. Thus, it is important that any sediment, once dislodged from the firearm, can fall freely to the bottom of the tank 200 (FIG. 11).

Figure 14:
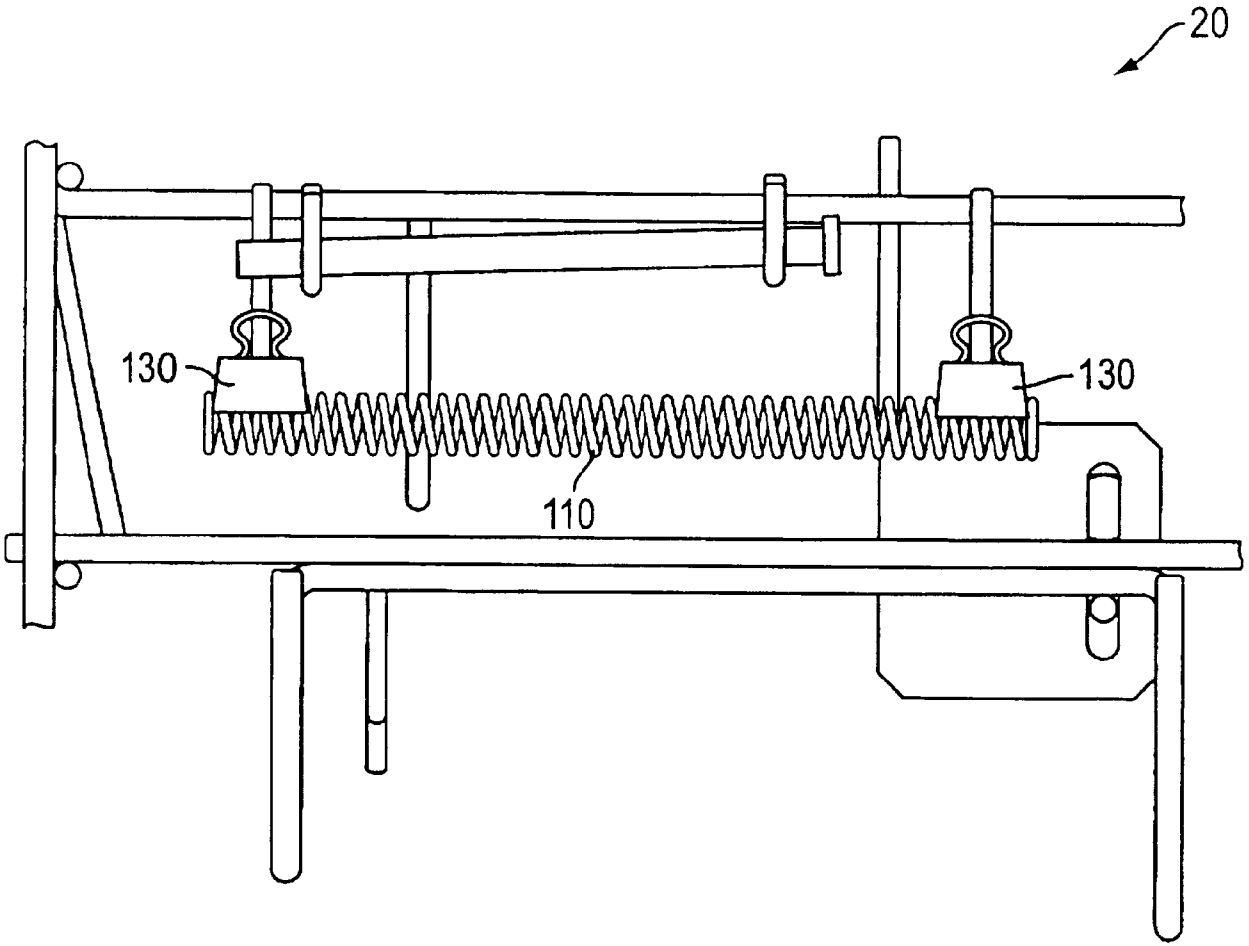
FIG. 14 is a front view of a portion of the gun rack of the invention illustrating a gun part supported by clips.
Figure 15:
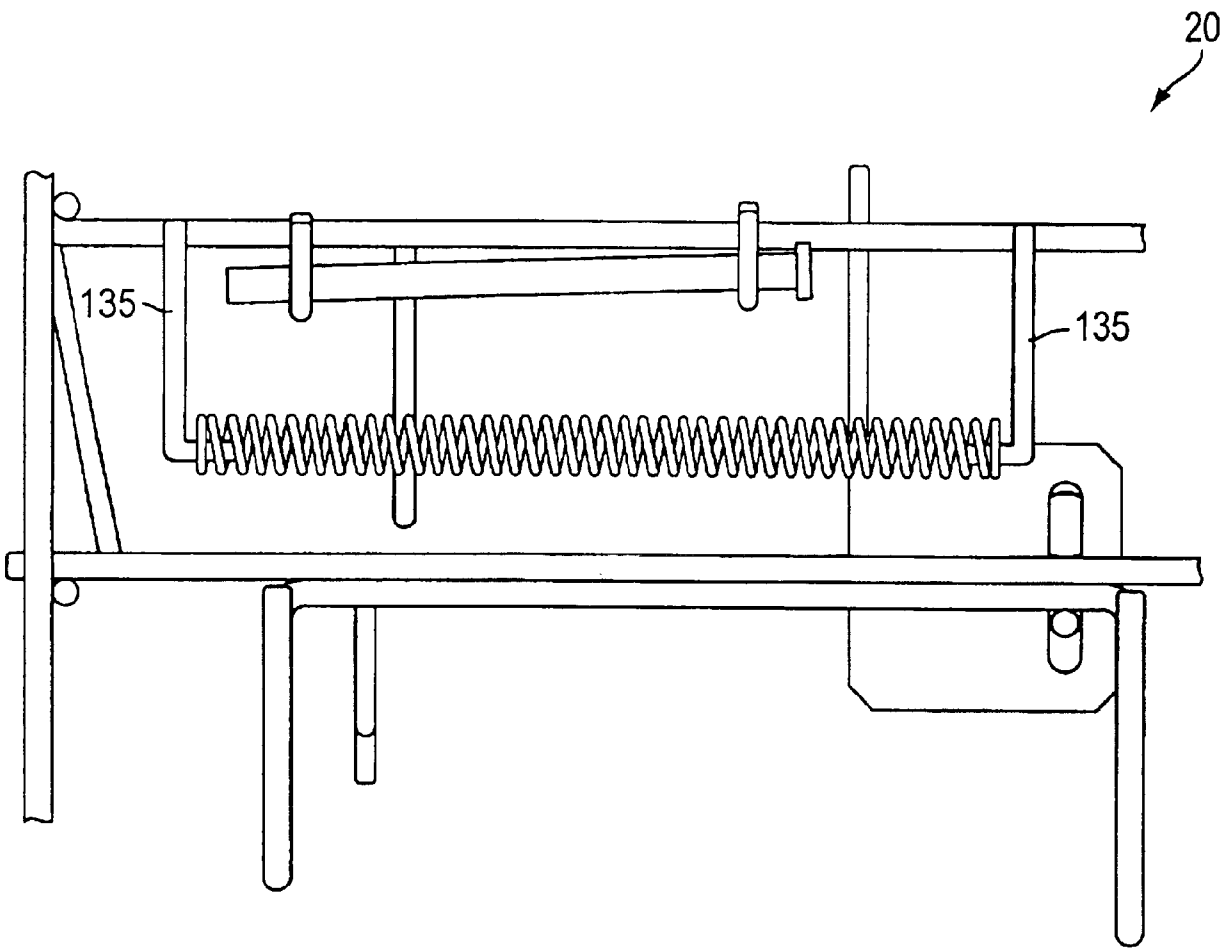
FIG. 15 is a front view of a portion of the gun rack of the invention illustrating a gun part supported by pins.

While the gun rack of the present invention is illustrated mainly with the use of "U" shaped wire supports, other supporting means are contemplated. For example, FIG. 14 illustrates the use of clips 130 or the like for suspending a gun part 110 from above, while FIG. 15 illustrates the use of pins 135 for suspending a gun part 110 from the sides. In certain situations, it might be preferable to retain certain gun parts on the rack of the invention using alternative supporting or suspending means when it is desired, for example, to fully expose a "dirty" surface to ultrasonic waves without obstructing any part of such surface by a wire support. In most cases, however, the obstructions caused by the hook supports will have a negligible effect on cleaning effectiveness. In addition, while only support 94 is illustrated as being adjustable, other supports may be vertically or horizontally adjustable as desired.

Figure 11:
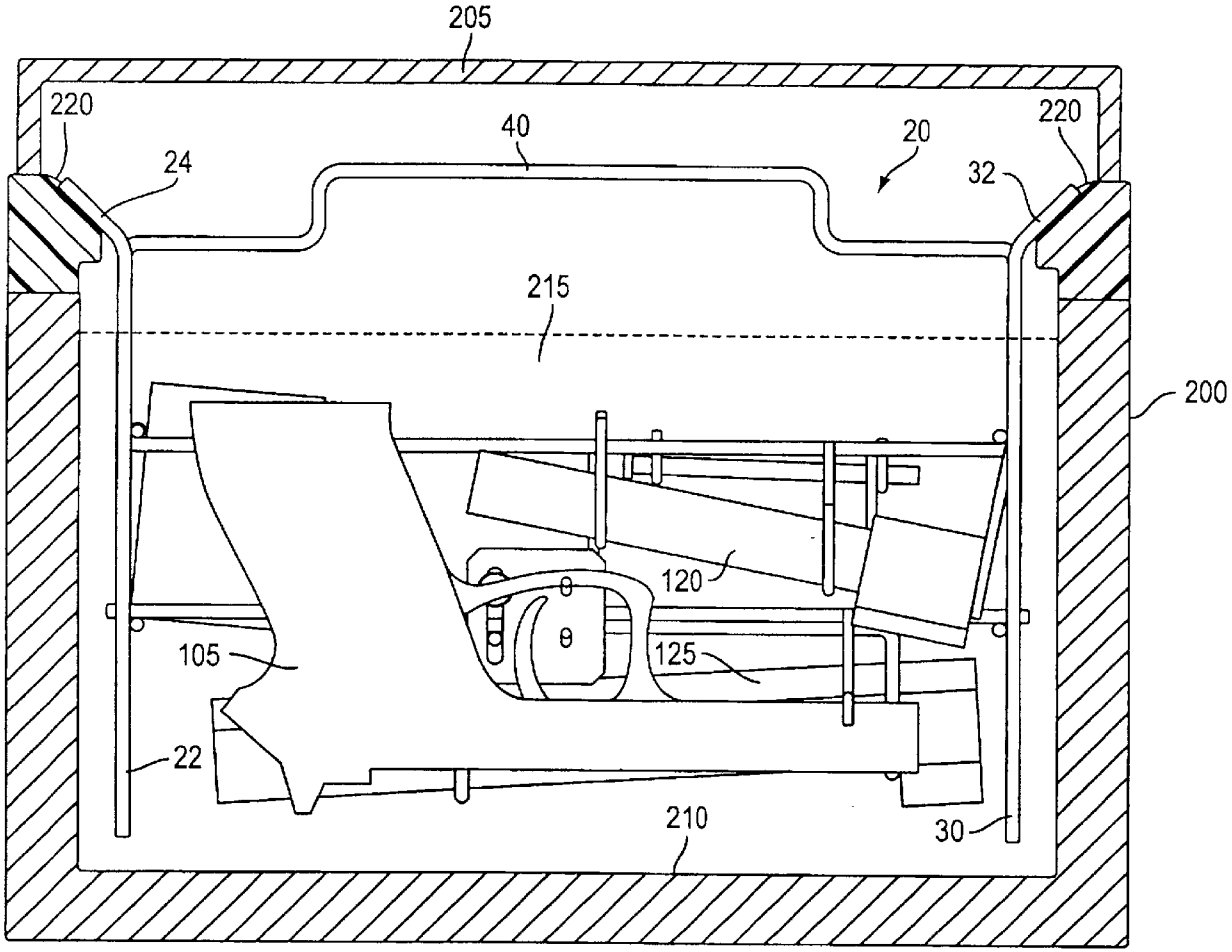
FIG. 11 is a front view of the gun rack of the present invention with gun parts supported on said rack and said gun rack immersed in an ultrasonic cleaning bath.

FIG. 11 illustrates an ultrasonic cleaning tank 200 into which a gun rack 20 of the invention is submerged. Tank 200 has a cover 205, a floor 210, an ultrasonic cleaning solution 215 and straight or angled walls 220 adapted to receive the upper ends 24,28,32,36 (FIG. 1) of the legs 22,26,30,34 of the gun rack 20 of the invention. The upper ends 24,28,32,36 of the gun rack legs rest on the angled walls 220 so that the gun rack 20 is suspended in the cleaning solution 215 and the bottom of the rack is elevated off the tank floor 210. Such a suspended arrangement is highly desirable since there is no "barrier" between the surface which is to be cleaned, i.e., the gun parts, and the surface which is radiating the ultrasonic (cleaning) energy. As noted above with prior art ultrasonic cleaning baskets that have basket floors and the like, any barrier between the radiating (vibrating) surface, i.e. the tank bottom 210, and the items to be cleaned, i.e. the gun parts, will diminish the cleaning effectiveness. Since the gun rack 20 of the present invention does not include a barrier between the gun parts and the floor 210 of the tank 200, cleaning effectiveness is maximized.

The legs, horizontal members, extension members and associated gun part supports are preferably formed from metal, which efficiently conduct ultrasonic vibrations better than plastic. Forming such parts from plastic may undesirably dampen the ultrasonic cleaning effectiveness when a loaded rack is submerged in an ultrasonic cleaning bath (FIG. 11). However, because it is highly desirable to reduce metal-to-metal wear between the parts being supported and the supports that hold such parts, it is preferable if the gun part supports are coated with a cushioning material such as plastic or the like. While the entire gun rack 20 may be plastic-coated, it may only be necessary to coat the supports that actually contact the gun parts to be cleaned. It is preferable if the gun part supports are plastic coated since metal-to-metal contact between the gun part and its support can wear the gun part down. This can have life threatening implications if the critical components are worn such as the rails (not specifically shown) for the slide. Worn critical components may cause a firearm to malfunction. A malfunctioning firearm in an emergency situation has obvious implications. Thus, plastic, being softer than the metal gun part, will wear before the metal gun part itself.

Use of the gun rack 20 of the present invention is fairly straightforward. A firearm is either "field" or "detail" stripped and its associated parts are positioned on the gun rack. Most handgun parts will be positioned on the gun rack as shown in FIGS. 6–7, with or without the need to adjust the receiver support 94 as shown in FIGS. 8A–8B. If the firearm is "detail" stripped, small parts 101 will be placed in the basket 50 and the basket will be attached to the rack. Otherwise, the basket can remain detached from the rack. After the rack is loaded with gun parts, the rack is submerged in an ultrasonic cleaning bath (FIG. 1) and exposed to ultrasonic cleaning energy. Such ultrasonic cleaning causes debris and sediment to dislodge from the gun parts and fall to floor of the bath. Since most gun parts will be positioned with their "dirtiest" sides or ends facing the bottom of the ultrasonic cleaning bath, the debris and sediment will fall to the floor of the bath in an efficient, unobstructed fashion without become redeposited on one or more of the gun parts. After a predetermined time, the rack is removed from the cleaning bath and dried. Since most of the debris and sediment that has been dislodged from the firearm is now located on the floor of the ultrasonic cleaning bath, it is not necessary to wipe or otherwise clean the gun parts again once such parts have been removed from the bath.

The gun rack of the present invention is highly effective by virtue of the strategic positioning of gun parts on the rack and the suspended positioning of the rack in an ultrasonic cleaning bath. The gun rack illustrated in the figures describes one potential support structure and one potential arrangement of supports. For example, a gun rack may only have one side or surface for supporting gun parts, or such rack may have a plurality of surfaces arranged in interesting geometric configurations. The gun rack of the present invention efficiently uses space on both sides of the rack so that the rack can be accommodated in a compact ultrasonic cleaning bath. Clearly, other rack configurations are contemplated, either to conform to a particular arrangement of gun parts or a particular ultrasonic cleaning bath.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

What is claimed is:

1. A retainer for submersion in a cleaning bath and for retaining objects to be cleaned, said bath having a peripheral wall and a floor, said retainer comprising:

a) a plurality of frame members having upper ends and lower ends defining an opening between said lower ends, b) a plurality of bracing members extending between said plurality of frame members for maintaining said retainer in a freestanding position, c) means for maintaining said retainer off said floor, d) a plurality of support members arranged at different heights, at least one of said plurality of support members being height-adjustable, e) wherein said plurality of support members are configured to optimize the cleaning of said objects, and f) means to prevent an object supported on said height-adjustable support member from rotating about said height-adjustable support member.

2. A retainer in accordance with claim 1, further comprising a small parts basket removably attachable to said retainer and having draining means.

3. A retainer in accordance with claim 1, wherein at least one of said plurality of support members is provided with a protective means.

4. A retainer in accordance with claim 3, wherein said protective means further comprises a covering to prevent damage to objects supported on said at least one support member.

5. A retainer in accordance with claim 4, wherein said covering is a plastic coating applied to said at least one support member.

6. A retainer in accordance with claim 4, further comprising at least two pairs of cooperating support members adapted to retain different objects.

7. A retainer in accordance with claim 4, wherein said retainer further comprises a front side and a rear side and said plurality of support members are arranged on said front and said rear sides of said retainer.

8. A retainer in accordance with claim 7, wherein said upper ends of said frame members are outwardly angled.

9. A retainer in accordance with claim 8, further comprising a handle member extending between at least two of said plurality of bracing members.

10. A retainer in accordance with claim 4, wherein said at least one of said plurality of support members is a "U" shaped support member.

11. A retainer in accordance with claim 1, wherein said upper ends of said frame members are adapted to maintain said retainer off said floor.

12. A retainer in accordance with claim 1, wherein at least one of said plurality of support members further comprises a clip member.

13. A retainer in accordance with claim 1, further comprising a support adapted to hold an object in an angled or vertical orientation.

14. A retainer for submersion in a cleaning bath and for retaining objects to be cleaned, said bath having a peripheral wall and a floor, said retainer comprising:

a plurality of frame members having upper ends and lower ends defining an opening between said lower ends, b) a plurality of bracing members extending between said plurality of frame members for maintaining said retainer in a freestanding position, c) means for maintaining said retainer off said floor, d) a plurality of support members arranged at different heights, at least one of said plurality of support members being provided with a covering to prevent damage to objects supported on said at least one support member, e) wherein said plurality of support members are configured to optimize the cleaning of said objects, f) wherein said retainer further comprises a front side and a rear side and said plurality of support members are arranged on said front and said rear sides of said retainer, g) wherein said upper ends of said frame members are outwardly angled, and h) further comprising a handle member extending between at least two of said plurality of bracing members, i) wherein at least one of said plurality of support members is connected to said handle member.

15. A retainer for submersion in a bath for cleaning gun parts, said gun parts comprising at least a lower receiver having a handle and a trigger section, a slide, and a barrel, said bath having a peripheral wall and a floor, said retainer comprising:

a) means for suspending said retainer off the floor of said bath to provide a debris passage between said retainer and said floor, b) a first support adapted to hold a gun lower receiver in an upside-down orientation with the handle and trigger section facing opposite said bath floor, c) a second support adapted to hold a gun barrel in an angled or vertical orientation, and d) a third support adapted to hold a gun slide in a substantially horizontal or angled orientation, e) wherein at least one of said supports is adjustable.

16. A retainer in accordance with claim 15, wherein at least two of said supports are arranged on said retainer at different heights.

17. A retainer in accordance with claim 15, further comprising means to prevent rotation of said gun lower receiver about said first receiver support when supported thereon.

18. A retainer in accordance with claim 17, wherein said first receiver support further comprises a pair of spaced-apart prongs adapted for engagement with said trigger section of said gun lower receiver.

19. A retainer in accordance with claim 15, wherein said retainer further comprises a front side and a rear side and said supports are arranged on said front and said rear sides of said retainer.

20. A retainer in accordance with claim 15, further comprising a small parts basket.

21. A retainer in accordance with claim 15, wherein at least one of said supports is adapted to support its respective gun part from above such that an unobstructed debris passage is defined between said respective gun part and the floor of said ultrasonic cleaning bath when said retainer is situated in said bath.

22. A retainer for submersion in an ultrasonic cleaning bath that radiates ultrasonic cleaning energy, said bath having a peripheral wall and a floor, said retainer comprising:

a) means for supporting said retainer relative to said peripheral wall of said bath, b) a plurality of bracing members extending between said supporting means for maintaining said retainer in a freestanding position, c) upper ends of said supporting means defining means for maintaining said retainer off said floor of said bath, and d) a plurality of support members specifically adapted to hold gun parts, e) wherein a barrier-less passageway is defined between said retainer and said floor to optimize the exposure of ultrasonic cleaning energy to said gun parts.

23. An ultrasonic cleaner comprising:

a) an ultrasonic cleaning chamber that emanates ultrasonic energy and having a peripheral wall and a floor, b) a retainer positionable in said chamber, c) means for maintaining said retainer off said floor, d) a plurality of support members provided on said retainer, at least one of said plurality of support members being height-adjustable, e) wherein a barrier-less passageway is defined between said retainer and said floor to optimize the exposure of ultrasonic cleaning energy to said plurality of support members, and f) further comprising means to prevent an object supported on said height-adjustable support member from rotating about said height-adjustable support member.

24. An ultrasonic cleaner an accordance with claim 23, wherein said plurality of support members are adapted to retain a plurality of separate gun parts.

25. An ultrasonic cleaner in accordance with claim 23, further comprising a small parts basket removably attachable to said retainer and having draining means.

26. An ultrasonic cleaner in accordance with claim 23, wherein at least one of said plurality of support members is provided with means to prevent damage to an object supported on said at least one support member.

27. An ultrasonic cleaner in accordance with claim 26, wherein said damage preventing means is a coating applied to said at least one support member.

28. An ultrasonic cleaner in accordance with claim 23, wherein said retainer further comprises a front side and a rear side and said plurality of support members are arranged on said front and rear sides.

29. An ultrasonic cleaner in accordance with claim 23, wherein said retainer further comprises frame members having outwardly angled upper ends that engage said peripheral wall.

* * * * *